US006985081B2

(12) United States Patent
Wagner et al.

(10) Patent No.: US 6,985,081 B2
(45) Date of Patent: Jan. 10, 2006

(54) DEVICE AND METHOD FOR DETECTING FIRE SOURCES OF GAS IMPURITIES

(75) Inventors: Ernst Werner Wagner, Winsen/Aller (DE); Florence Daniault, Hannover (DE)

(73) Assignee: Wagner Alarm-und Sicherungssysteme GmbH, Langenhagen (DE)

( * ) Notice: Subject to any disclaimer, the term of this patent is extended or adjusted under 35 U.S.C. 154(b) by 8 days.

(21) Appl. No.: 10/478,375

(22) PCT Filed: May 24, 2002

(86) PCT No.: PCT/EP02/05734

§ 371 (c)(1),
(2), (4) Date: Nov. 21, 2003

(87) PCT Pub. No.: WO02/095703

PCT Pub. Date: Nov. 28, 2002

(65) Prior Publication Data

US 2004/0145484 A1 Jul. 29, 2004

(30) Foreign Application Priority Data

May 25, 2001 (DE) ..... 101 25 687

(51) Int. Cl.
*G08B 17/10* (2006.01)

(52) U.S. Cl. ..... 340/628; 340/286.05; 340/524; 169/60; 73/863.31

(58) Field of Classification Search ..... 340/628, 340/524, 286.05, 629, 630, 632, 511, 517, 340/521; 169/60, 56; 73/863.31, 31.02, 73/863.11

See application file for complete search history.

(56) References Cited

U.S. PATENT DOCUMENTS 4,764,758 A * 8/1988 Skala ..... 340/627

(Continued)

FOREIGN PATENT DOCUMENTS

DE 11 54 379 9/1963

(Continued)

OTHER PUBLICATIONS

Patent Abstracts of Japan Publication No. 09147266 A, published Jun. 6, 1997.

*Primary Examiner*—Anh V. La
(74) *Attorney, Agent, or Firm*—Nixon & Vanderhye P.C.

(57) ABSTRACT

Fire sources or gas impurities are detected and located in one or several monitoring chambers by a device having a main detector for detecting a fire characteristic value or a gas impurity, into which a part of the ambient air in the monitoring chambers is continuously injected by an intake unit through a line, arranged in each monitoring chamber and provided with intake ports. The advantages of gas inlet systems, such as an active intake and a concealed assembly, is therefore combined with the advantage of the localization of each intake port as well as the detection of a precise fire source or a precise gas impurity. To this end, the device is provided with a sub-detector, arranged on or in the area of at least one intake port per monitoring chamber, for detecting a fire characteristic value or a gas impurity. The sub-detector is capable being switched on by a switch-on signal transmitted by a controller according to a detection signal delivered by the main detector.

23 Claims, 5 Drawing Sheets

U.S. PATENT DOCUMENTS

| | | | | |
|---|---|---|---|---|
| 4,771,808 | A * | 9/1988 | Rodger | 137/613 |
| 4,818,970 | A | 4/1989 | Natale et al. | |
| 5,477,218 | A * | 12/1995 | Manmoto et al. | 340/630 |
| 5,917,417 | A * | 6/1999 | Girling et al. | 340/628 |
| 6,125,710 | A | 10/2000 | Sharp | |
| 6,685,104 | B1 * | 2/2004 | Float et al. | 239/63 |

FOREIGN PATENT DOCUMENTS

| | | |
|---|---|---|
| DE | 32 37 021 | 5/1983 |
| EP | 1 006 500 A2 | 6/2000 |
| FR | 2 670 010 | 6/1992 |
| WO | WO 93/23736 | 11/1993 |
| WO | WO 00/68909 | 11/2000 |

* cited by examiner

DEVICE AND METHOD FOR DETECTING FIRE SOURCES OF GAS IMPURITIES

This application is the U.S. national phase of international application PCT/EP02/05734 filed 24 May 2002 which designated the U.S.

BACKGROUND OF THE INVENTION

The invention relates to an apparatus for detecting and locating sources of fire or gas impurities in one or more chambers under surveillance, with a (main) detector for detecting a fire, to which detector a constant portion of the air contained in each chamber under surveillance is directed by means of a suction unit, the air travelling along a pipe which is provided in each chamber under surveillance and which has suction openings, as well as a process for the individual recognition of fires or gas pollution in one or more chambers under surveillance, utilizing a (main) detector, which is connected along a pipe and through suction openings on the pipe with the chamber under surveillance, to enable the continual withdrawal and assessment of gaseous test samples from the chamber under surveillance.

Processes and apparatuses of the kind under discussion are known in the prior art and have developed to the point where, for example, in large halls, high shelving, double flooring or office chambers, the locating of a fire source can present extreme difficulties for fire-fighters. A single smoke suction system with a single fire-detecting unit—depending upon local requirements—may monitor a region up to 2000 $m^2$, which can include a number of rooms. In order to permit fire fighters to quickly locate the alarm position, requirements have been laid down; for example in Germany there is the "Guide for Automatic Fire Reporting Installations, Planning and Construction" (VDS 2095). According to this publication, several rooms can be grouped together into a reporting region, only if the rooms are neighbouring rooms, their access can be easily taken in at a glance, the total surface area does not exceed 1000 $m^2$, and also at the fire reporting central station there are clearly visible optical alarm indicators which, in the event of a fire alarm, can identify the room where the fire is located. In Great Britain the requirements are set forth in Norm BS 5839 "Fire Detection and Alarm Systems for Buildings, part 1—code of practice for system design, installation and servicing". According to these rules, the reporting area of a single surveyed zone must not exceed 2000 $m^2$. Further detailed stipulations are given for the searching distance, which for the optical recognition by fire-fighters of a fire source within a zone, may not exceed 30 m. As a possible aid to detection, it is recommended to include alarm lamps at various locations.

When herein the term "Brandkenngrosse" (characteristic fire quantity) is used, it is to be understood in terms of physical measurements which underlie measureable alterations in the vicinity of a break-out fire, for example the local temperature, the atmospheric content of solid materials, liquid materials or gaseous materials (the creation of smoke particles or aerosols, or steam), or the local radiation.

In FR 2 670 010 A1 reporting boxes are disclosed which serve to identify the smoke-sucking joint in a branched suction pipe system. This reporting box consists of a point-formed smoke detector built into a housing with cable threading for the connection of the incoming and outgoing pipes, and a signal light on its cover. A disadvantage of this construction is that these signal boxes cannot be supplied at every single suction opening, because of their size, their constructional form and their price.

WO 00/68909 discloses a process and an apparatus for detecting fires in chambers under surveillance, by means of which can be located the source of a fire or of pollution of a gas mixture enclosed by the surveillance space. To this end, the process and the corresponding apparatus utilize, in each space under surveillance, two pipes which there cross each other, and by means of which, using one or more fans, a constant fraction of the air in the chamber under surveillance or in the gas mixture is withdrawn through such an opening provided in the pipes, and is conveyed to at least one detector per pipe for recognizing a fire source or a source of gas pollution. This achieves the location of the fire source or of the pollution source, by consulting both of the detectors with respect to the crossed pipes. Several rooms are under surveillance through pipes arranged in the manner of a matrix with rows and columns, and if need be each with a collection detector for the row and column configuration. A disadvantage of this known apparatus lies in the very substantial installation outlay for the matrix pipe system.

The German Patent DE 3 237 021 C2 discloses a selective gas/smoke detector system with a number of separate suction conduits which are connected at various measurement positions in a room under surveillance, in order to withdraw air or gas samples at these measurement positions. In this arrangement, a gas or smoke detector, in communication with these conduits, reacts to the presence of a particular gas in the probe if a defined threshold value is exceeded, and produces a detection signal which controls an indicator or an alarm switch. Also on the individual suction conduits are arranged closure valves which, by a control loop, are cyclically and periodically controlled. The recognition of a fire using this gas/smoke detection system takes place as follows: the control unit, in the absence of a detection signal, adjusts the closure valves such that all suction conduits are simultaneously in open connection with the detector, and upon receipt of a detection signal switch over to a scanning sequence, by which the suction conduits, usually one after the other, or in groups, are brought into connection with the detector. This functioning for the recognition of a fire source requires above all that the detector, by way of individual and selectively openable conduits, be capable of being brought into connection with the various spaces under surveillance individually. Of necessity, this requires the installation of an extensive conduit system, in order to create these individually selectable connections. A disadvantage of this system is the very high installation cost for the necessary conduits.

Disclosed in International Patent Application WO 93/23736 is an air pollution/smoke recognition apparatus based on a network suction system with a large number of sampling locations at which a gas is removed from the individual room under surveillance. This air pollution/smoke recognition apparatus has control of a number of inlet openings which are connected to the grid-like suction system, and are individually monitored. Under normal circumstances, all of these inlets are open, until the recognition apparatus recognizes polluted air or smoke. By the selective closing of inlet openings it is a simple matter to recognize and determine the boundaries of the fire zone. However, the functioning of this recognition apparatus also requires an extensive installation of suction conduit which must provide a grid-like structure in order to ensure a reliable recognition of a fire source. Here as well, a disadvantage of this known appratus lies in the high cost of installing the conduit system.

SUMMARY OF THE INVENTION

The object of the present invention is to provide an apparatus and a method for detecting a source of fire or gas pollution, which combines the advantages of known gas suction systems, such as active suction and hidden mounting, with the advantage of locating each individual suction opening, and thus makes possible the detection of a definite fire source or a definite instance of gas pollution in a simple and cost-effective manner.

This object is attained by way of a first apparatus for detecting a fire source or gas pollution, in which, to recognize a fire source or gas pollution, a sub-detector is provided at or in the region of at least one suction opening per chamber under surveillance, the sub-detector being switched through a control which is dependent on a detection signal produced by the main detector.

An important point regarding the present invention is that, based on the already widespread use of installations for smoke and gas suction systems—also called aspirative monitoring systems—the only approach that makes sense is a simple and cost effective retrofitting to achieve individual detection of fire sources or gas pollution, in the light of current norms. At the same time one must avoid a situation where an appropriate retrofitting runs into substantial construction and operating costs because of a necessity to meet the desired safety standards. In accordance with the present invention, the requirements of a simple retrofitting for an aspirative system with minimal operating cost is obtained in that, in the region of or at each suction opening, a simple and inexpensive individual sub-detector is provided, which is switched on only in the case of a fire, in order to save current. The sub-detector can be a smoke reporting device, for example a transillumination smoke detector, a scattered light detector, a heat detector, a combustion gas detector, a gas pollution detector, an ionization smoke detector, or a combination of several of the foregoing detectors. Such a sub-detector is easily retrofitted, independently of the complexity and extent of a conduit system monitored by a main detector, and independently of the space to be monitored, such as halls, high self storage, double floors or office spaces. Each sub-detector includes its own sensor with signal-testing facility.

Under the possibly extreme conditions of a fire outbreak there is advantageously provided a central send module or send/receive module for producing the switch-on signal and a receive module or send/receive module on each sub-detector, to receive the switch-on signal. In order to avoid current, the sub-detectors are deactivated so long as the fire sensors are turned off along with their signal-checking facility. Only the receive module or the send/receive module of each sub-detector is constantly ready for operation. To ensure the independence of the house electrical grid in the case of a fire, the switch-on directive can be transmitted along an individual low-voltage line which is especially protected against the effect of fire (cable, bus system, and so on). It is essential that the sub-detector be installed so as not to be directly at the suction opening of a conduit, however it can, depending on the particular conditions of the space as well as technical safety considerations, be installed at a further distance from the suction opening. This then is practical if the space under surveillance is used to store highly inflammable or explosive materials, such that, after they explode, the more distantly mounted main detector produces a detection signal with regard to a fire source, and the central send module or send/receive module then causes the switching on of the sub-detectors, which in the region of a sub-detector mounted on a suction opening would certainly already be destroyed.

Preferably, after activation of the sub-detectors in the event of fire, the send/receive module gives a detection signal to the sub-detector mounted in the region of the fire source, which is received by the central send/receive module, which beforehand brings about the switching-on of the sub-detectors. This detection signal from the send/receive module of a sub-detector can deal not only with a localized formation, but also with further fire data, for example temperature, smoke development, and so on. There thus becomes available, for assessing the extent and the development speed of a fire, timely and comprehensive information.

Impairment of the communication between the central send module or send/receive module and the receive module or send/receive module of a sub-detector, in the case of fire, would preferably be counteracted by having the central send module or send/receive module and the receive module or send/receive module of each sub-detector connected with one another through a wireless connection, or being capable of switching to a wireless connection. The switch-on command from the central send module or send/receive module can be transmitted by wireless, infrared, ultrasound or the like. The individual sub-detectors are provided with a corresponding receive module or send/receive module—e.g. a radio module, an infrared module, etc. This communication variant between central send module or send/receive module and receive module or send/receive module for each sub-detector is very simple to retrofit, since no expense is encountered for installing a cable system.

A particularly secure and inexpensive communication between a central send module or send/receive module and the receive module or send/receive module of each sub-detector is attained in that a) advantageously, each receive module or send/receive module of a sub-detector is equipped with an air current sensor; in that b) the central send module or send/receive module is connected with the suction unit, and that c) as a switch-on signal by way of the suction unit, there is adjustably provided a predefined suction air stream, which is recognized by the air current sensor of each receive module or send/receive module of a sub-detector as a switch-on signal. This version of the present invention offers the advantage that right way the expensive-to-install and thus cost intensive components of an apparatus for detecting fire sources or gas pollution, such as the pipe conduit system, can be utilized as a communications medium. The central send module or send/receive module causes the suction unit to give out a pneumatic switch-on command, this unit being so controlled in the event of a fire alarm that, by way of a short term adjusted predefined air current, an air stream alteration takes place which is interpreted by all connected individual sub-detectors as a switch-on command.

Advantageously, this air stream alteration is generated in order to create the switch-on signal by means of the suction unit. In this case, a further module for the creation of a switch-on signal is superfluous, which makes possible particularly the cost effective further utilization of installed modules of an existing aspirating fire detection system.

According to a further development, the sub-detectors are provided with their own voltage sources. Here as well a role is played by the technical security aspect of the independence of the sub-detectors of energy fed along cables or the like. Especially in the case of fire, electrical cables are often quickly damaged by the heat effect, so that the function-readiness of the sub-detectors at the fire source can no longer be guaranteed. If the sub-detectors have access to their own voltage sources, this danger is eliminated. It is conceivable, in this regard, to construct the voltage sources not merely as primary electrical cells, but rather also as secondary electrical cells (Akku), which, at least in lighted spaces, are charged by a solar cell mounted in the region of the individual sub-detector.

In case of a fire alarm, the time lapse between the outbreak of the fire and the utilization of adequate counteracting steps plays a decisive role. The quick notification of fire fighting personnel is advantageously handled in that the sub-detectors of the spaces under surveillance are connected to an alarm indicator apparatus, or can achieve such connection. This alarm indicator apparatus can be located in the premises of a building under surveillance, or also in the central fire station of the closest fire fighting capability.

For the arriving firemen, but also for the other people who happen to be in the area of danger, local sub-alarm indicator apparatuses are important for survival. For the simplest possible retrofitting of these sub-alarm indicator apparatuses, for example LED-indicators, audible alarms, or the like, the easiest solution is mounting various units on each sub-detector itself. It is also conceivable to mount sub-alarm indicator apparatuses not only on the corresponding sub-detectors, but possibly also in the local region, if they are more visible at such a location.

A particularly efficient transmission of fire alarm information for the guidance of the fire fighters in appropriate numbers and with appropriate equipment is made possible if the direction signal given out by a sub-detector is transmitted over a transmission apparatus to a fire report central station. This will minimize the time delay between fire recognition and the initiation of efforts to put out the fire, with simultaneously the most complete possible information.

A transmission apparatus of this kind can include, preferably, a processor unit, a coupling unit with a special ASIC or an alarm member connected to an alarm line. In this way, various selectable technologies are available as information to be passed along, which can be matched to the corresponding need.

The object is also attained by way of a further apparatus, each with a magnetic valve in the region of at least one suction opening per surveillance space, and a control by which each magnetic valve is closed or opened depending upon a detection signal given out by the main detector through a switch-on signal.

The foregoing brings up an important thought, namely that with a specific opening or closing of the valves in one or more spaces under surveillance, a fire source or a source of gas pollution can be located utilizing the greater or lesser degree to which the gaseous stream is loaded with fire or gas indicators. With the process yet to be described below, or a leakage in a gas conduit, the iterative localization, for example of a fire source, is possible.

Advantageous further embodiments of the inventive apparatus are set forth in sub-claims 13–18.

First of all there is a send module for initiating a switch-on signal, and a receive module for each magnetic valve, in order to receive the switch-on signal. The send module and also the receive module can consist of an electronic switch for wire-connected control of a magnetic coil, which controls the opening and closing of the valve. By way of such a send module it is possible to centrally control all valves or the valves when grouped together by regions.

A wireless, radio-based communication between the send module and the receive module is preferred, which for example in the case of a fire ensures a particularly reliable control. It is also conceivable, for a local area, to have a light-based communication, for example in the infrared region, or a communication in the ultrasonic region.

The magnetic valves, in their simplest and most cost-effective form, are provided with a conical closure body and a correspondingly shaped valve seat. For reasons relating to the technical aspects of current—in order to avoid too great a level of suction resistance—it is possible to provide a spherical closure body, which creates minimal turbulence in the gas stream at the valve. Regarding the construction, it is possible to combine the shapes, for example a conical closure body in a spherical housing for the magnetic coil, in order to prevent too great a throttle affect.

To achieve a quick recognition of a fire source or a source of gas pollution in the gas stream, it is of advantage for the valves to be in the open condition when unstressed; thus they do not require to be first activated in order to suck air out of all suction openings. The magnetic coil is preferably without voltage, in order to save current. In a pull-valve, a spring keeps the open valve in the open condition, until the coil is activated and pulls the valve against the valve seat. Also possible is the use of lift valves which are closed when there is no voltage, and are opened only after activation of the coil.

It is also of advantage for the magnetic valves to have access to their own voltage sources. Indeed, if there is radio control of the valves from a central send module, all cables would be unnecessary, which would make the valves, in the event of a fire, the least sensitive to external influences, and thus they would be the most reliable.

An alarm indicator apparatus at or in the region of the magnetic valves can indicate the activation state and the location of the valves either acoustically or optically. If identification is carried out, it is possible to give a flashing signal which alerts people in the surrounding area to the acute danger of burning.

The object of the present invention is attained by way of a first process for the individual recognition of fire sources or sources of gas pollution, in which the process steps of:

a) switching on, in the region of the suction openings, of mounted sub-detectors, upon recognition of a fire start or the pollution of a gas, by way of the main detector, b) recognition of the fire source or the source of gas pollution by way of the switched-on sub-detectors, and c) indicating the fire source or the source of gas pollution with the help of an alarm signal, are performed.

This process can be carried out with an apparatus of the kind described and offers the advantages already explained in detail. The carrying out of the process steps in the form described herein offers the highest possible level of reliability within the safety and economic aspects required in the specifications of the present invention. In particular, the carrying out of the fire recognition in two steps, firstly by the main detector and then by the switched sub-detectors, makes possible a solution which is cost effective and acceptable from the standpoint of current safety standards. It should be noted in this connection that, instead of fire recognition, the pollution of a gas or gas mixture by way of disturbance variables can generally be reliably detected.

The object of the present invention can also be attained by way of a further process for the individual recognition of fire sources or sources of gas pollution, carrying out the following process steps:

a) closing a number of magnetic valves (20) at or in the region of the suction openings (3) upon recognition of a fire source or a source of gas pollution by way of the main detector (1);

b) noting an increase or decrease of the source of fire or the source of gas pollution, by comparison with the previous step;

c) closing a number of the open valves (20) upon an increase of the source of fire or gas pollution; or d) closing the open valves (20) and opening a number of valves (20) closed in the foregoing step in the event of a decrease in the fire or the gas pollution;

e) repeating steps b) through d) until it is no longer possible to detect an increase in the source of fire or gas pollution in the gas stream, or the most recently opened valve (20) points to the source of fire or of gas pollution; and f) indicating the source of fire or of gas pollution with the help of an alarm signal.

The magnetic valves can be taken together in groups, whereby one group of valves is closed if a source of fire or of gas pollution is recognized at the main detector. If there is now an increase in the measured number of fire or gas indicators, this is an indication that more air is being removed by the valves, for example to the direct fire location, thus there is a fall in the contribution of unloaded air from the ambience of the closed valves. In this case, the still open valves are closed group-wise, whereby it is again determined whether an increase or a decrease in the fire or gas indicators shows up at the main detector. In the case of a decrease, it can be concluded that the valves in the region surrounding the fire are closed, upon which the proportion of unloaded air increases. In this case, the previously closed valves are again open, and other valves are closed.

The iterative process is continued until finally no further increase in the fire or gas indicators is noted; therefore one or—in larger premises such as storage buildings—a group of valves are located which are at or as close as possible to the fire source. Subsequently this is indicated with the help of an alarm signal.

Advantageous further developments of the apparatus in accordance with the invention are set forth in the sub-claims 12 and 22.

Following this, preferably a warning signal, which is at or in the region of all magnetic valves or at the entrance door to the indicated space in step a) of the locating process, is given out. At the beginning at the locating process, for example, all alarm indicators can flash, whereas at the end of the process only the alarm indicator at the source of fire—for example above the entrance door—switches over to continuous light, while all others are turned off.

In order to warn individuals in the area surrounding a fire, it is of advantage for a warning signal at or in the region of the open magnetic valves to flash during the locating process in steps b) to e).

BRIEF DESCRIPTION OF THE DRAWINGS

The present invention is further described below using a concrete example embodiment. There is illustrated.

DETAILED DESCRIPTION OF THE PREFERRED

Figure 1:
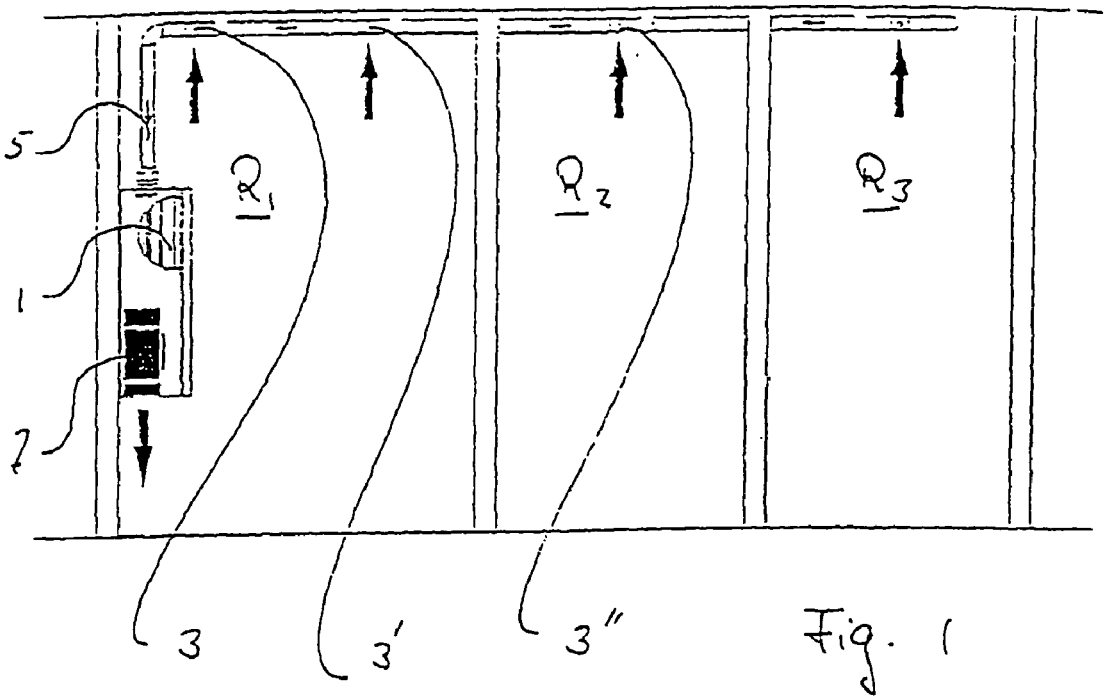
In FIG. 1: a lateral section through chambers R1, R2, R3 in which is mounted an apparatus for the detection of fire sources in accordance with the state of the art.

Similar or similarly operating portions are identified below using the same reference numerals.

FIG. 1 shows a lateral section through the chambers R1, R2, R3, within which is provided an apparatus for recognizing fires, in accordance with the current state of the art. Particular attention is drawn to a pipe 5 which connects all illustrated chambers R1, R2, R3, the pipe having suction openings 3, 3', 3" communication with chambers R1, R2, R3 respectively. The pipe communicates in chamber R1 with an apparatus having a main detector 1 and a suction unit 7. When the suction unit 7 is in operation, chamber air is withdrawn from the chambers R1, R2, R3 by way of the suction openings 3, 3', 3", and is directed along the pipe 5 to the main detector 1.

Figure 1A:
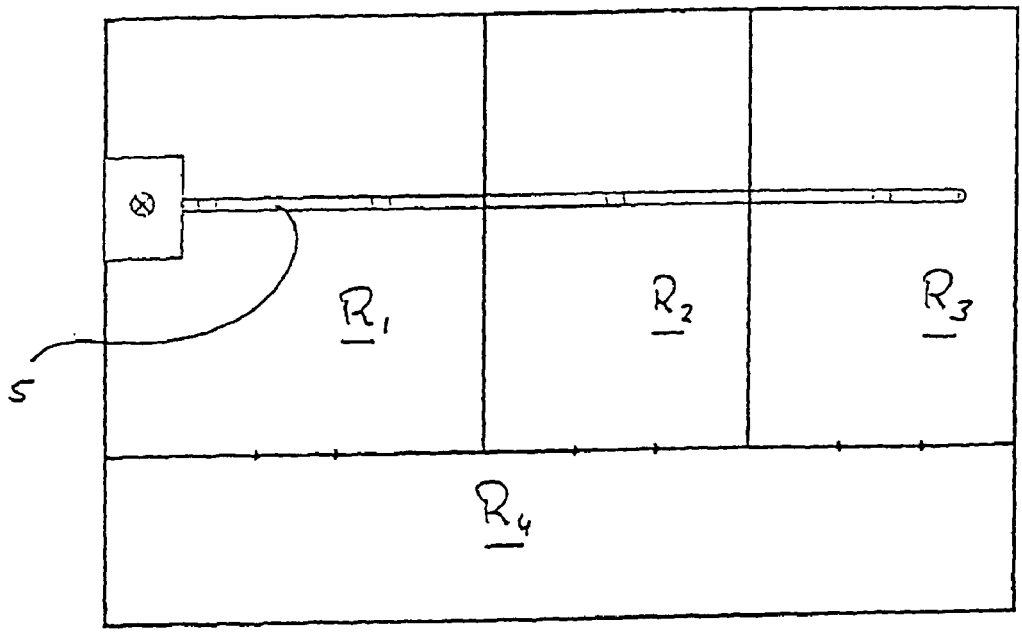
In FIG. 1A: a plan view of the chambers of FIG. 1.

FIG. 1A is a plan view of the chambers of FIG. 1, wherein there is shown a chamber R4 (corridor) connecting the chambers R1, R2, R3. The illustrated embodiment of an apparatus for detecting fire in accordance with the state of the art makes it clear that the individual detection of fire sources in the individual chambers R1, R2, R3 is not possible with an apparatus of this construction. The main detector 1 cannot determine the magnitude or the source chamber of the fire on the basis of chamber air drawn in through the pipe 5.

Figure 2:
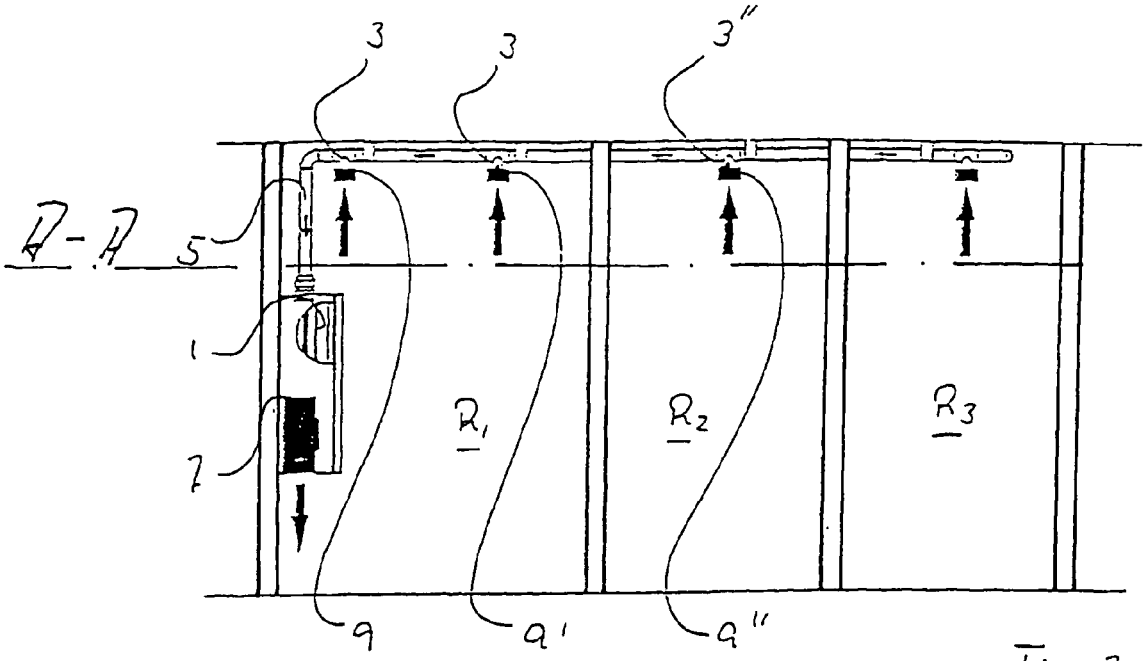
In FIG. 2: a lateral section through chambers R1, R2, R3, within which is mounted an apparatus for the detection of fire sources in accordance with the present invention.
Figure 2A:
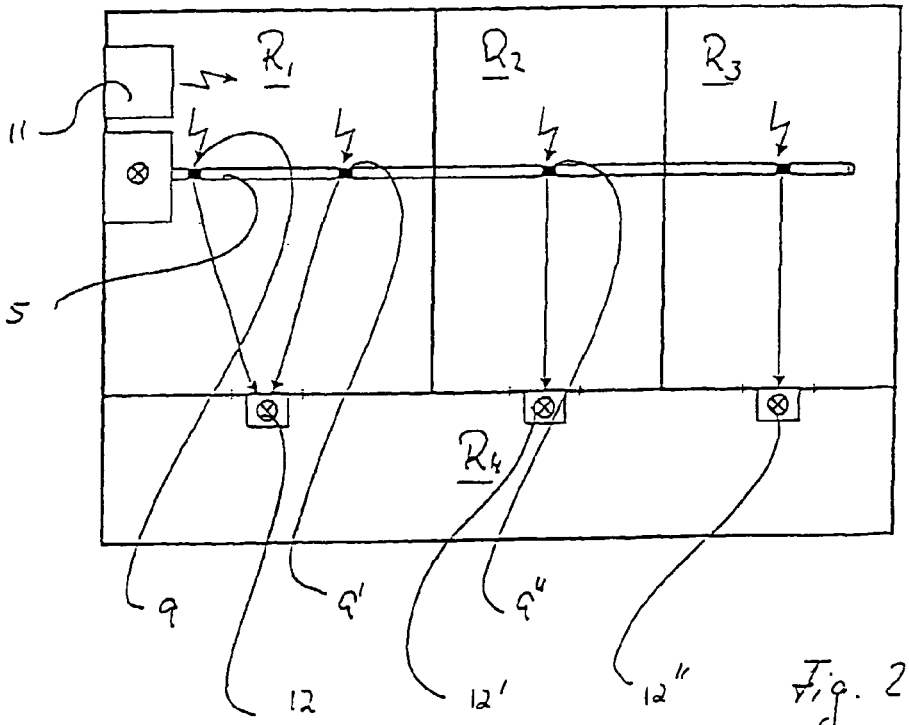
In FIG. 2A: a plan view of the chambers of FIG. 2.

FIG. 2 shows a lateral section through chambers R1, R2, R3, in which is mounted an apparatus for the detection of fire sources in accordance with the present invention. In comparison with the embodiment of the state of the art shown in FIGS. 1 and 1A, certain components have been added which may seem minor, but which are critical to success. In the embodiment shown in FIG. 2, the suction openings 3, 3', 3" are equipped with sub-detectors 9, 9', 9", which are switched on in the event of the detection of a fire through the main detector 1. The switching-on of the sub-detectors 9, 9', 9", in this embodiment, is handled by a control 11 utilizing a corresponding wireless signal. The control 11 in FIG. 2A, which is a section through chambers R1, R2, R3 of FIG. 2 taken along the line A—A, is to be understood as a plan view. In FIG. 2A, in the region of the doors from the chamber R4 (corridor) to the chambers R1, R2, R3, there are also provided corresponding sub-alarm indictor devices 12, 12', 12". Thus, if a fire source is detected by way of the main detector 1, following which the control 11 triggers the switching on of all sub-detectors 9, 9', 9", the fire source can be recognized as being in one or several of the chambers R1, R2, R3. These sub-detectors 9, 9', 9" remain in contract with the sub-alarm indicator apparatuses 12, 12', 12" and signal by this means the location of the fire source in the chamber R4 so that fire fighters can immediately be directed to the fire location. Since the sub-detectors 9, 9', 9" are in wireless contact with the control 11, it is also possible to pass the fire data by way of the control 11 to an alarm indicator apparatus, in a central portion of the building, or in a central part of the building, or in a fire reporting central station.

Figure 3:
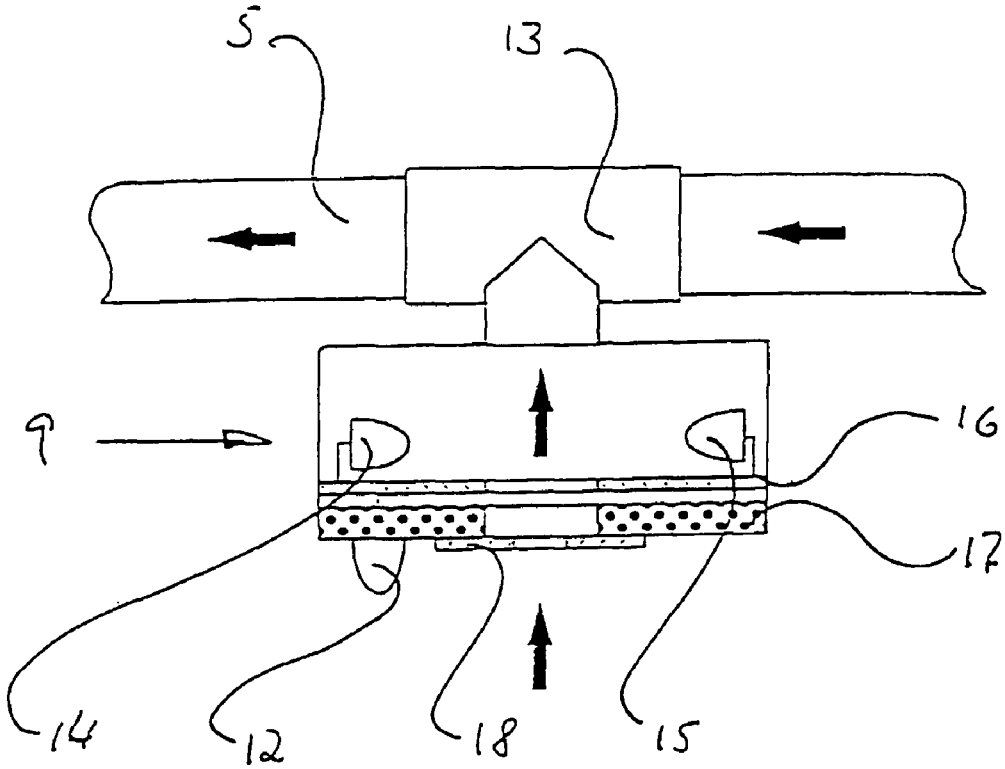
In FIG. 3: a partly sectioned illustration of a sub-detector in accordance with the present invention.

FIG. 3 is a section through a sub-detector 9, which is mounted by way of a T-member 13 on the pipe 5. The basic construction of the sub-detector 9 consists of a source of light 14 and a light receiver 15, between which the sucked up chamber air flows along the T-fitting 13 into the pipe 5. This arrangement is also known a light-transmitting signaller, functioning similarly to a photoelectric barrier, which upon recognition of light intensity fluctuations, arising due, for example, to soot particles or the like, generates an electrical signal. For this reason the light source 14 and the light receiver 15 are mounted on a plate 16, which also creates a connection to the sub-alarm indicator. Alternatively, the sub-detector 9 can also be provided with a light-scattering device, wherein the light receiver is positioned outside of the direct path of the light source. In a scattered light signaller, no light falls on the receiver when no particles are present at the centre of the scattered light. In the case of fire, light is scattered by the smoke particles, and light falls on the receiver. The sub-alarm indicator apparatus 12 is in the form of a light emitting diode. Provided in the region of the opening of the sub-detector 9 into the chamber is a suction reducer 18 with a downstream dust filter 17. With this arrangement of a suction reducer 18 and dust filter 17 it is certain that, across all suction openings 3, 3', 3" of the pipe 5, there will be established a sufficient air stream between the light source 14 and the light receiver 15, for the detection of a fire source by way of the sub-detector 9, wherein simultaneously the false recognition of air dust as an indicator for a fire source will be excluded. Furthermore, the sub-detector 9 is provided with a connection for standard pipe or fittings (sleeves, T-fittings) which guarantees multiple uses. On the basis of the simple embodiment, here illustrated, of the sub-detector 9, the latter is the preferred form of an apparatus for detecting fire sources.

Figure 4A:
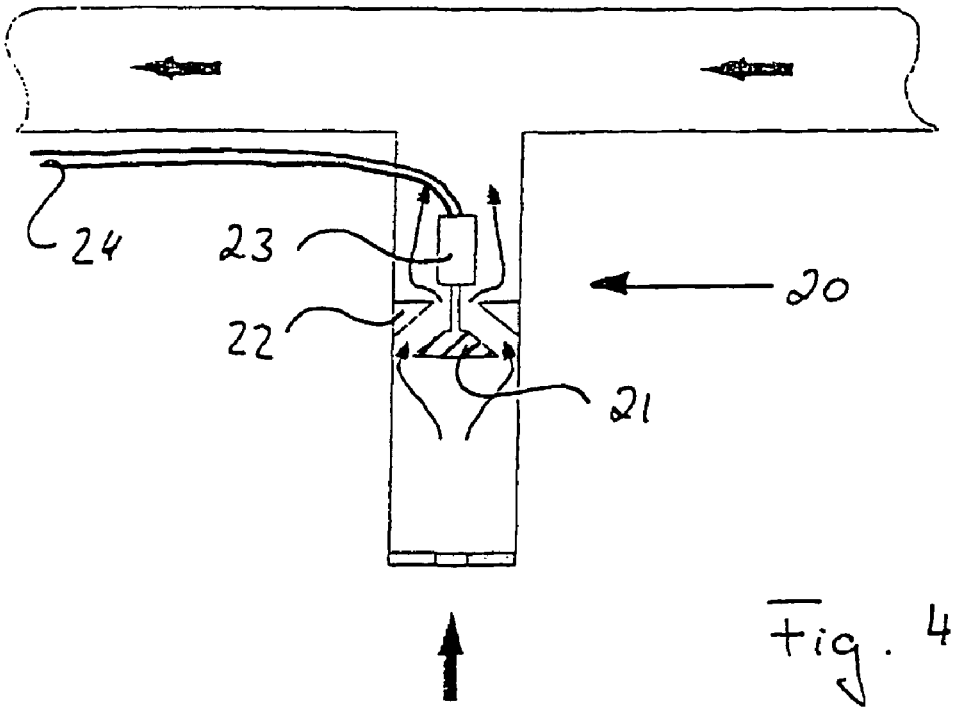
In FIG. 4A: a sectioned side view of an open magnetic valve positioned in a suction support.

FIG. 4A shows a sectioned side view of an open magnetic valve 20 in a suction support, the valve consisting of a closure body 21 which is drawn against its valve seat 22 with a magnetic coil 23. The control of the valve 20 is exerted by the central send module over the line 24.

Figure 4B:
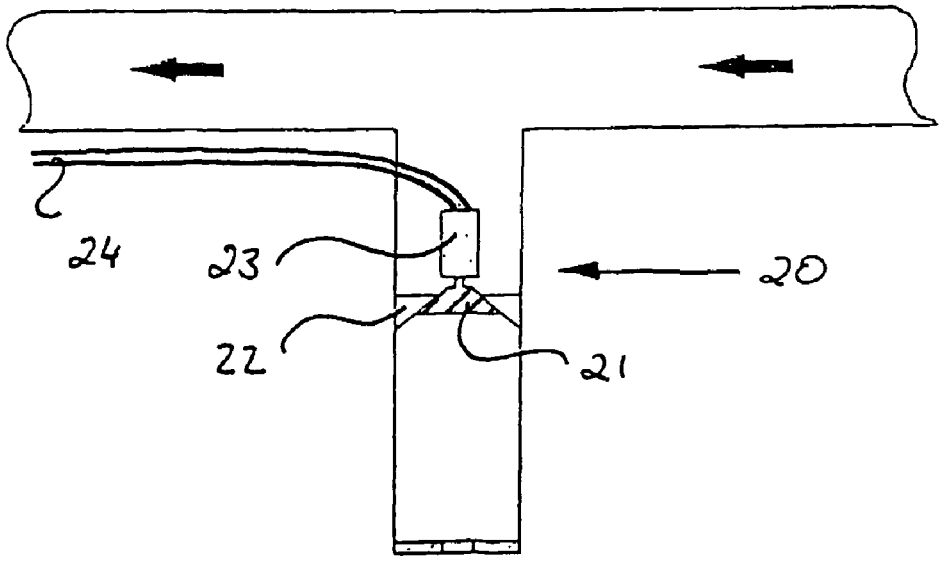
In FIG. 4B: a sectioned side view of the magnetic valve of FIG. 4A, here in the closed position.

FIG. 4B shows a sectioned side view of the magnetic valve of FIG. 4A, however here it is in the closed position. To minimize the throttle resistance, it is possible to construct the valve 20 with a spherical valve head 21, and/or with a coil 23 accommodated in a spherical housing.

Figure 5:
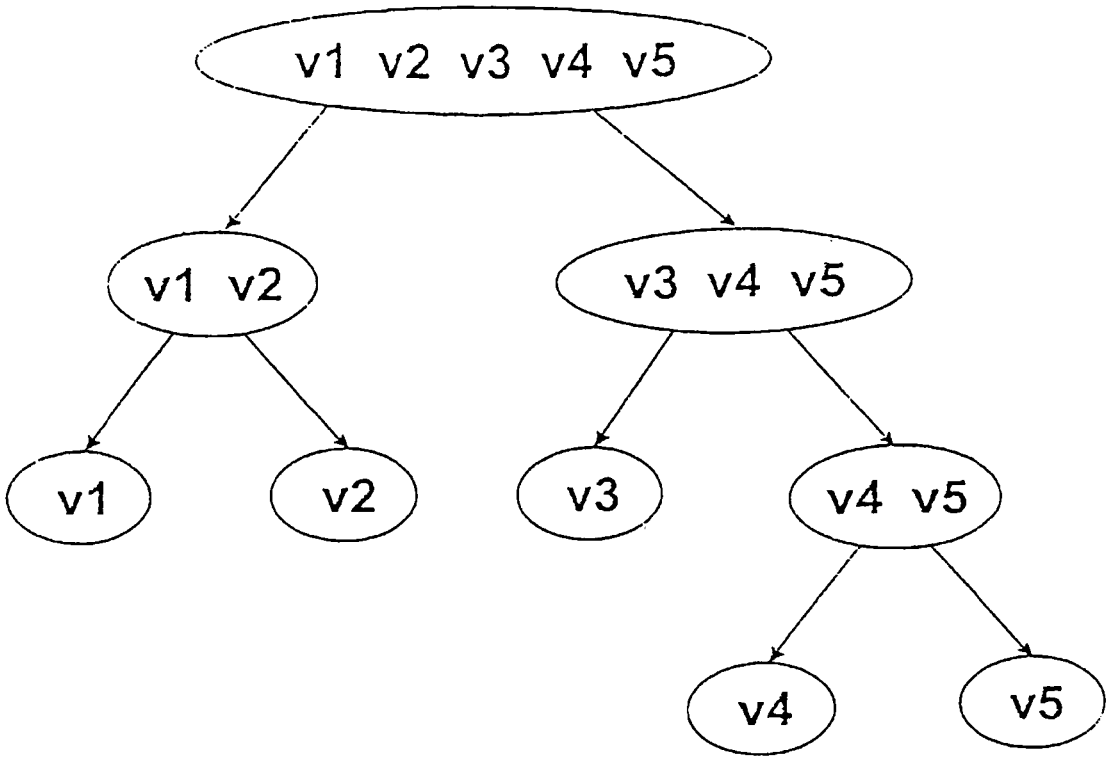
FIG. 5: a schematic plan view showing the group-wise distribution of valves to clarify the locating process in accordance with the invention.

FIG. 5 is a schematic overview of the group-wise distribution of valves, useful to clarify the locating process in accordance with the invention. When the main detector detects a developing fire, the valve arrangement begins an iterative process of positioning. In the example are seen 5 suction openings (V1 to V5) for monitoring five separate chambers. If now the two valves V1 and V2 are closed, the others V3, V4, V5 remain open, and the measured smoke level decreases. The fire is therefore to be looked for in the group of the closed valves V1 and V2. Then the valves V3, V4, V5 and V1 are closed, thus leaving only V2 open. If the measured smoke level increases, then this connects V2 with the fire. If not, then V1 is the fire location. It can be seen from the drawing that, with five suction openings, the fire source can be located after a maximum of three steps.

The general approach is to divide the total of the smoke-sucking openings step-wise into two groups, until this total includes only a single suction opening. With n steps, one suction opening out of $2^n$ openings can be located, as the following table indicates:

| Number of Suction Openings | Number of Steps for Locating |
|---|---|
| 1 . . . 2 | 1 |
| 3 . . . 4 | 2 |
| 5 . . . 8 | 3 |
| 9 . . . 16 | 4 |
| . | . |
| . | . |
| . | . |
| $(2^{n-1}+1) \ldots 2^n$ | n |

At this point it should be noted that all of the above described parts can be considered separately and in any combination, and in particular the details illustrated in the drawings are claimed as important to the invention. Modifications thereof will be immediately evident to the person skilled in the art.

What is claimed is:

1. Apparatus for detecting and locating fire sources or gas pollutants in one or more chambers under surveillance ($R_1$, $R_2$ . . . $R_n$), said apparatus comprising:

a main detector (1) for detecting a fire or gas pollution, and for issuing a detection signal in response to detecting a fire or gas pollution, a suction unit (7) and a pipe (5) having a plurality of suction openings (3) respectively provided in each chamber under surveillance ($R_1$, $R_2$ . . . $R_n$) for constantly supplying a portion of air contained in the chambers under surveillance to the main detector, a remote sub-detector (9) for recognizing a fire or gas pollution at or in the region of at least one suction opening (3) per each of the chambers under surveillance ($R_1$, $R_2$ . . . $R_n$), and a controller (11) operatively connected to each sub-detector, said controller including a central send/receive module for issuing a switching signal in response to receiving the detection signal issued by the main detector (1), wherein said sub-detector includes a remote send/receive module for receiving the switching signal.

2. An apparatus according to claim 1, wherein each remote send/receive module of one or more of the sub-detectors (9) sends a detection signal, and wherein the central send/receive module receives the detection signal.

3. An apparatus according to claim 1, wherein the central send/receive module is capable of being in wireless contact with a corresponding remote send/receive module of each sub-detector (9).

4. An apparatus according to claim 1, wherein the remote send/receive module for each sub-detector (9) includes an air current sensor, and the central send/receive module is connected with the suction unit (7), and wherein a predefined suction air stream is adjustable as a switching signal by way of the suction unit (7), the stream being recognized by the air stream sensor of the the remote send/receive module at each sub-detector (9) as a switch-on signal.

5. An apparatus according to claim 1, wherein the remote send/receive module at each sub-detector (9) includes an air stream sensor, and wherein the central send/receive module is connected to the suction unit (7), and wherein, to create the switching signal by means of the suction unit (7), a predefined alteration of the suction air stream can be created, which is interpreted as a switching signal by the air stream sensor of the remote send/receive module at each sub-detector (9).

6. An apparatus according to claim 1, wherein each sub-detector (9) is equipped with its own voltage source.

7. The apparatus according to claim 1, further comprising an alarm indicator central station (10), and wherein at least one sub-detector of a chamber under surveillance ($R_1$, $R_2$ . . . $R_n$) is capable of being in contact with the alarm indicator central station (10).

8. An apparatus according to claim 1, further comprising an alarm indicator apparatus (12) provided at each sub-detector (9).

9. An apparatus according to claim 1, further comprising a fire indicator central station, and a transmission device for transferring a detection signal from a sub-detector (9) to the fire indicator central station.

10. An apparatus according to claim 9, wherein the transmission device has a processor unit, a coupler unit with a special ASIC, or an alarm member connected to an alarm line.

11. An apparatus according to claim 10, wherein the magnetic valve (20) includes a conically or spherically shaped closure body (21) and a valve seat (22) co-operating therewith.

12. An apparatus according to claim 10, wherein the magnetic valve (20) is open when at rest, and the magnetic coil (23) is under no voltage.

13. An apparatus according to claim 10, wherein each magnetic valve (20) is provided with its own source of voltage.

14. An apparatus according to claim 10, further comprising an alarm indicator apparatus (12) at or in the region of each magnetic valve (20).

15. A process for the separate recognition of fire sources or gas pollution in one or more chambers under surveillance ($R_1$, $R_2$ . . . $R_n$) according to claim 1, with the (main) detector (1) which is connected with the chambers under surveillance ($R_1$, $R_2$ . . . $R_n$) by way of the pipe (5) and suction openings (3) provided in the pipe (5), for the continuous withdrawal and analysis of gas samples from the chambers under surveillance ($R_1$, $R_2$ . . . $R_n$);

characterized by the following steps:

(a) upon recognition by the main detector (1) of a source of fire or of gas pollution, switching on sub-detectors (9) mounted at or in the region of the suction openings (3);

(b) recognition of the fire source or the source of the gas pollution by the switched-on sub-detectors (9); and (c) indicating the fire source or gas pollution source with the help of an alarm signal.

16. A process for the separate recognition of fire sources or gas pollution in one or more chambers under surveillance ($R_1$, $R_2$ . . . $R_n$) according to claim 1, with the (main) detector (1) which is connected with the chambers under surveillance ($R_1$, $R_2$ . . . $R_n$) by way of the pipe (5) and suction openings (3) provided on the pipe (5), for the continuous withdrawal and analysis of gas samples from the chambers under surveillance ($R_1$, $R_2$ . . . $R_n$);

characterized by the following steps:

(a) upon recognition, by the main detector (1), of a source of fire or gas pollution, closing a number of magnetic valves (20) mounted at or in the region of the suction openings (3), while recognizing with the main-detector (1) the evidence of fire or of gas pollution in the gas stream;

(b) noting an increase or decrease in the evidence of fire or gas pollution recognized in the gas stream, compared with the previous step;

(c) upon an increase in the fire source or gas pollution, closing a number of open valves (20) or (d) upon a decrease in the fire source or gas pollution, closing the open valves (20) and opening a number of the valves (20) which in the previous step were closed;

(e) continuing to cycle through steps (b) to (d) until no increase can be detected in the fire source or gas pollution contained in the gaseous stream, or until the last open valve (20) points to the fire source or the source of the gas pollution; and (f) indicating the fire source or the source of the gas pollution with the help of an alarm signal.

17. A process according to claim 16, characterized by a warning signal at or in the region of all magnetic valves (20) in step (a) of the recognition process.

18. A process according to claim 16, characterized by a warning signal at or in the region of the open magnetic valves (20) during the recognition process in the steps from (b) to (e).

19. Apparatus for detecting and locating sources of fire or of gas pollution in one or more chambers under surveillance ($R_1$, $R_2$ . . . $R_n$) comprising:

a main detector (1) for detecting a fire or gas pollution, and for issuing a detection signal in response to detecting a fire or gas pollution, a suction unit (7) and a pipe (5) having a plurality of suction openings (3) respectively provided in each chamber under surveillance ($R_1$, $R_2$ . . . $R_n$) for constantly supplying a portion of air contained in the chambers under surveillance to the main detector, a plurality of magnetic valves, wherein each magnetic valve (20) is positioned at or in the region of at least one suction opening (3) per chamber under surveillance, and a controller (11) operatively connected to each magnetic valve (20), wherein the controller includes a central send module for issuing a switching signal in response to the detection signal provided by the main detector (1), wherein said magnetic valves include a receive module for opening or closing respective ones of the magnetic valves in response to receiving the switching signal from the controller.

20. An apparatus according to claim 19, wherein the central send module is in wireless communication with the corresponding receive module of each magnetic valve (20) or can enter into such connection.

21. A process for the separate recognition of fire sources or gas pollution in one or more chambers under surveillance comprising the steps of:

(a) providing a device having main detector for detecting evidence of a fire or gas pollution and for recognizing a fire or gas pollution based on the detected evidence thereof, the main detector being connected operatively with the chambers under surveillance by a pipe, the pipe having suction openings adapted to allow withdrawal of gas samples from the chambers under surveillance for analysis by the main detector;

(b) closing a number of magnetic valves mounted at or in the region of the suction openings in response to detection by the main detector of evidence of a fire or gas pollution in the gas samples;

(c) determining a change in the evidence of fire or gas pollution recognized in the gas samples and either (i) closing a number of open valves in response to an increase in the evidence of fire or gas pollution, or closing the open valves and opening a number of the valves which in the previous step were closed in response to a decrease in the evidence of fire or gas pollution;

(d) continuing to cycle through steps (b) and (c) until either no increase in the evidence of fire or gas pollution can be detected in the gas samples, or until the last open valve indicates a source of the fire or gas pollution and issuing a signal in response thereto.

22. A process according to claim 21, comprising issuing a warning signal at or in the region of all magnetic valves in response to the main-detector recognizing the evidence of fire or of gas pollution in the gas stream according to step (b).

23. A system for the separate recognition of fire sources or gas pollution in one or more chambers under surveillance comprising:

a main detector for detecting evidence of a fire or gas pollution and for recognizing a fire or gas pollution based on the detected evidence thereof, a pipe connecting the main detector with the chambers under surveillance, the pipe having suction openings adapted to allow withdrawal and analysis of gas samples from the chambers under surveillance;

a number of magnetic valves mounted at or in the region of the suction openings, and a controller operatively connected to the main detector and the magnetic valves for receiving a detection signal from the main detector indicative of the evidence of a fire or gas pollution and for issuing a switching signal to the magnetic valves in response to determining a change in the evidence of fire or gas pollution and either (i) closing a number of open valves in response to an increase in the evidence of a fire or gas pollution, or closing the open valves and opening a number of the valves which were previously closed in response to a decrease in the evidence of a fire or gas pollution until no increase in the evidence of a fire or gas pollution can be detected in the gas samples, or until the last open valve indicates a location of a source of fire or gas pollution, whereupon the controller issues a signal in response thereto.

* * * * *